US006125556A

United States Patent [19]

Peckler et al.

[11] Patent Number: 6,125,556

[45] Date of Patent: Oct. 3, 2000

[54] GOLF SHOE WITH HIGH LIQUID PRESSURE SPIKE EJECTION

[76] Inventors: Stephen N. Peckler, 8016 Montelena Ct., Sac., Calif. 95829; James A. Malloy, 1120 Calhoun Way, Stockton, Calif. 95207

[21] Appl. No.: 08/879,754

[22] Filed: Jun. 20, 1997

[51] Int. Cl.[7] ..... A43C 15/14; A43C 15/02; A43B 5/00

[52] U.S. Cl. ..... 36/127; 36/61; 36/134; 36/59 R

[58] Field of Search ..... 36/127, 61, 134, 36/59 R, 67 R, 67 A, 29, 3 R, 3 B

[56] References Cited

U.S. PATENT DOCUMENTS

| | | | |
|---|---|---|---|
| 1,361,078 | 4/1920 | Lynn | 36/61 |
| 3,793,751 | 2/1974 | Gordos | 36/61 |
| 4,159,582 | 7/1979 | Ostrowski | 36/67 D |
| 4,271,608 | 6/1981 | Tomuro | 36/61 |
| 4,375,729 | 3/1983 | Buchanen III | 36/61 |
| 4,715,133 | 12/1987 | Hartjes et al. | 36/127 |
| 4,763,426 | 8/1988 | Polus et al. | 36/29 |
| 4,821,434 | 4/1989 | Chein | 36/134 |
| 4,825,562 | 5/1989 | Chuang | 36/61 |
| 4,873,774 | 10/1989 | Lafever | 36/134 |
| 4,999,932 | 3/1991 | Geim | 36/29 |
| 5,113,599 | 5/1992 | Cohen et al. | 36/88 |
| 5,158,767 | 10/1992 | Cohen et al. | 36/88 |
| 5,289,647 | 3/1994 | Mercer | 36/88 |
| 5,299,369 | 4/1994 | Goldman | 36/61 |
| 5,341,581 | 8/1994 | Huang | 36/3 B |
| 5,505,010 | 4/1996 | Fukuoka | 36/3 B |
| 5,526,589 | 6/1996 | Jordan | 36/127 |
| 5,697,171 | 12/1997 | Phillips | 36/3 B |
| 5,706,589 | 1/1998 | Marc | 36/27 |

FOREIGN PATENT DOCUMENTS

| | | | |
|---|---|---|---|
| 9776 | 5/1880 | Germany . | |
| 1965198 | 8/1971 | Germany | 36/61 |
| 2262528 | 6/1974 | Germany | 36/61 |
| 3046811 | 7/1982 | Germany | 36/134 |
| 3644812 | 9/1988 | Germany | 36/134 |
| 1220618 | 3/1986 | U.S.S.R. | 36/28 |
| 22043 | of 1906 | United Kingdom | 36/3 R |

*Primary Examiner*—Paul T. Sewell
*Assistant Examiner*—Anthony Stashick
*Attorney, Agent, or Firm*—Jack Lo

[57] ABSTRACT

A golf shoe sole comprising ejecting and retracting spikes, the improvement wherein said sole contains a high pressure liquid pump assembly in communication with a plurality of housed cylinder assemblies each of which contain a slidable spike with seal, wherein extreme pressure being exerted upon contained liquid equals extreme firmness of ejected spikes. Said pump having shifting means of a four way rotatory spool valve for the control of ejection and retraction in either auto or manual mode, or said pump being one of the two, the former manual operating by way of lever reciprocating upon a piston. The latter auto, operating by way of a diaphragm located on the bottom soul of the back of the heel. Said diaphragm being subject to intense momentary pressure generated by the weight transference from the forward walking motion of the human wearer. An exclusively manual pump requiring only a two way ball, seat, and stem control valve. Liquid being drafted from a balloon type reservoir, then through a sequence of valves, is urged via conduit housing to act upon said sliceable spike assembly. Said spike assembly comprised of said socket, a sliceable spike with seal, a certain spring, which under compression collapses within it's self, a gasket and a threaded cylinder. Said cylinder has the absence of threads on it's upper portion, said upper portion has a smaller diameter than the root diameter of existing threads on it's lower portion. Thusly when the unit is assembled a space exists to accommodate liquid flow from ports positioned lower than the cylinder top. Liquid flow then travels over the top of inner cylinder walls and into said inner cylinder. Said cylinder has an outer domed convex bottom, identical in size and shape to that of conventional golf spikes, said outer bottom having two small blind bores enabling spike replacement with a conventional tool in the field. Said cylinder incorporates a gasket shoulder into it's shape, and has a small bushing bore in it's bottom to allow said spike to eject out for use.

20 Claims, 12 Drawing Sheets

FIG.6A
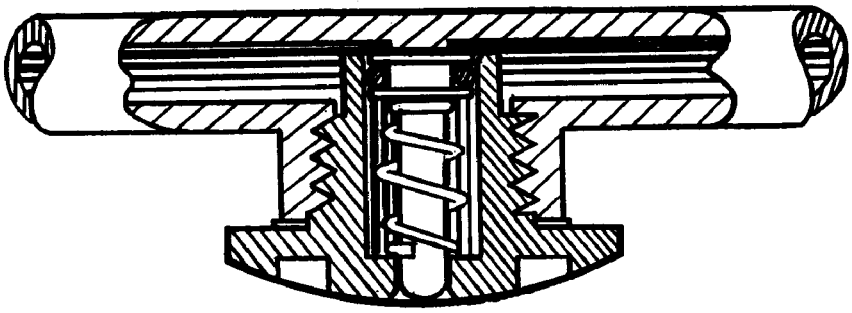
FIG.6B
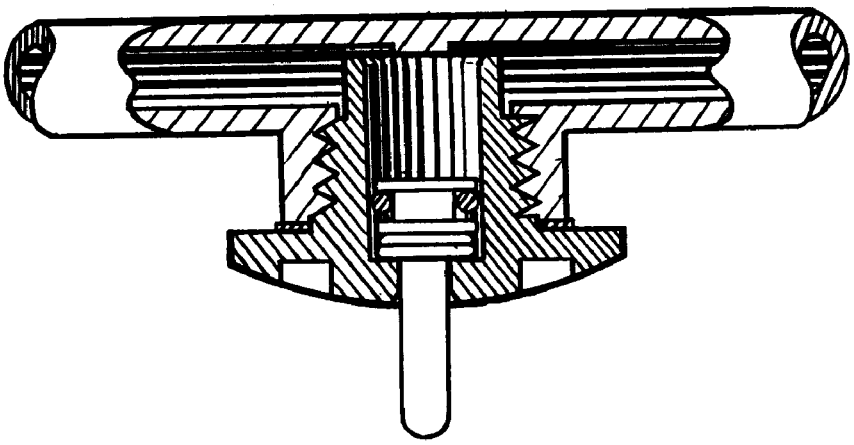
FIG. 6

GOLF SHOE WITH HIGH LIQUID PRESSURE SPIKE EJECTION

BACKGROUND—FIELD OF INVENTION

This invention relates to golf shoes, specifically of the type having ejecting and retracting spikes.

BACKGROUND—DESCRIPTION OF PRIOR ART

Conventional fixed spiked golf shoes have been the overwhelming choice among pro golfers since before Walter Hagen used them in his winning of the 1914 U.S. open. Traditional eight millimeter steel spikes that provide such superior traction during the golf swing, are still today the standard shoe among pro golfers.

There is seemingly no end to the unprecedented world wide boom in golfing of recent years. A massive increase in the number of golfers however, has created an unanticipated problem for many golf course owners. The fine putting surfaces have become subject to rapid deterioration brought on by thousands upon thousands of spike punctures each day along with numerous raised clumps of grass which interfere with put roll. The deleterious effects upon the root systems of putting greens has reached a level in hundreds of golf courses in which the owners have been forced to ban the use of traditional spiked golf shoes, in efforts to save their greens from total destruction.

The golf shoe industry has responded by producing golf shoe soles that do not penetrate the ground surface. A numerous array of gripping patterns and substitute short spike knobs have been the only alternative solution offered.

Although efforts of mass advertising of spike substitute shoes has created some appeal in the lay golfer market, observation reveals the vast majority of pro golfers still wearing the traditional ground penetrating eight millimeter steel spike, leaving very little doubt as to the superior traction gained from the traditional golf shoe.

The oversight in this dilemma, is that only the fine putting greens have been subject to spike overrun deterioration, and that the courser turf of the expansive fairways, having a much larger and deeper root system, have actually responded, if at all, favorably to the aeration effects of increased spike holes. It is fair to conclude then that grass deterioration from spikes has been limited to the putting greens.

It is also an oversight to assume that spikes are necessary on the putting greens. In so far as no traction is needed for putting, the same as in miniature golf, it is readily understood, by preponderance, that spikes are not in the least bit necessary on the putting greens, by any level of golfer.

It is on the fairway however, where numerous cases of broken ankles have been the result of slipping during fall swing, and it is on the fairways were the superior traction of traditional spikes are sourly missed.

There for in consideration of developing an ideal golf shoe that meets today's standards it would follow that a shoe possessing spikes for the fairways, and then possessing no spikes for the putting greens would be the ideal solution.

There have been prior attempts in designing a shoe that has ejecting and retracting spikes, hear also termed E.A.R. spikes. These prior attempts have been the work of separate individuals, some who have shown surprising ingenuity. Non of these prior attempts however have ever been produced, that is to say, made readily available on the sport shoe market. The review of prior art indicates an emerging technology in an infant state, not yet being evolved enough for mass marketing. It is not known that a design teem like that of a large corporation has ever embarked upon such a project.

The said prior attempts mostly fall into one of three groups of spike actuating means, (a) CAMS (b) SPRINGS and (c) FLUID PRESSURE. The cam designs have been explored in two forms, rotary cams and linear slidable cams.

The insurmountable problems associated with cams is that the parts are subject to rapid wear and breakage. When for example, a 200 pound person walks across a concrete path way on ejected spikes, the walking would permanently bend any metal rails or parts small enough to fit within the sole space requirements. Plastic parts of such a required smallness of size, would be subject to the bearing of an excessive load resulting in rapid part distortion and component separation. The necessary wide clearances between spike and wall induce spike wobble. For the above reasons, It would seem that cam designs would rate the highest in potential product failure. Further, sliding and rolling cams severely restrict the possible spike pattern positioning and sole flexibility.

Spring loaded E.A.R. spikes have been explored to some level. Although spring loaded spikes offer ease of manufacturing and a low cost, the main problem of undesirable spike retraction and insufficient ground penetration has remained unsolved.

Fluid pressure E.A.R. spikes have been designed to incorporate the use of air as the preferred medium. Examples are U.S. Pat. No. 5,526,589 Mar. 1, 1995 issued to Jordan, U.S. Pat. No. 4,873,774 Mar. 1, 1988 issued to Lafever, and U.S. Pat. No. 2,262,528 Jun. 20, 1974 issued to Bauer, Fed. Rep. of Germany. Do to the excessive compressibility of air and the smallness of available volume within a shoe, the same problem as in spring loaded spikes occurs, that of spike undependability, the spike's retreat into the sole when tread upon. The air pumps are of low pressure capability, approximately 25 p.s.i., incapable of supporting the weight of the human wearer.

The qualities exhibited by the popular fixed spike golf shoe are not found in the past attempted versions of E.A.R. spike shoes. It is to this end that E.A.R. spikes have not yet found their way into the golf shoe market.

OBJECTS AND ADVANTAGES

Accordingly, several objects and advantages of the present invention are:

(a) to provide the redesigning of popular fixed spike golf shoes, only in so far as the element of E.A.R. spikes goes, and leaving intact all the conventional desirable qualities resultant from decades of evolution.

(b) to provide the equivalent of conventional fixed spike firmness in an E.A.R. spike shoe (c) to provide high liquid pressure, in excess of 1000 p.s.i., for ejecting spikes (d) to provide a high liquid pressure slidable spike assembly that fits into conventional golf shoe sole thickness.

(e) to provide an E.A.R. spike shoe sole that is as flexible as the popular fixed spike shoes (f) to provide an E.A.R. spike shoe that is as comfortable as popular shoes (g) to provide an E.A.R. spike shoe that is as light in weight as present convention (h) to provide an E.A.R. spike shoe that has conventional appealing appearance (I) to provide that all elements of said shoe are suitable for cost efficient mass production (j) to provide a rugged E.A.R. assembly that will out last the shoe body life (k) to provide E.A.R. spiked shoes with minimal additional cost of production over that of convention (l) to provide for a reduction of ankle injury in the sport of golf (m) to provide for the preservation of golf course greens (n) it is an advantage to have high liquid pressure from a lever action pump in communication with a high liquid pressure slidable spike assembly (o) it is an advantage to have high liquid pressure from an auto diaphragm pump in communication with a high liquid pressure slidable spike assembly (p) to provide for the easy actuating of an E.A.R. spike shoe (q) to provide for the conventional ease of replacing spikes Further objects and advantages of our invention will become apparent from a consideration of the drawings and ensuing description.

DRAWING FIGURES

In the drawings, closely related figures have the same number but different alphabetic suffix FIG. 1 shows an exploded view including all elements being inserted into a shoe FIG. 2. shows an entire manual pump shoe in exploded view FIG. 3 shows an isometric section view of the liquid pressure slidable spike assembly FIG. 4 shows a conduit housing FIG. 5 shows an exploded section view of the liquid pressure slidable spike assembly FIGS. 6A and 6B show section views of housed spikes in retracted an ejected positions FIG. 7 shows a top section view of a manual pump assembly FIGS. 8 and 8*a* through 8*d* shows an isometric view of a manual pump body and three section views FIG. 9 shows a top view of a shoe sole with the assembly inserted, and a section view of a manual pump and actuating path of the pump lever FIG. 10 shows an alternate positioning of a control valve and lever pump.

REFERENCE NUMERALS IN DRAWINGS

Figure 1:
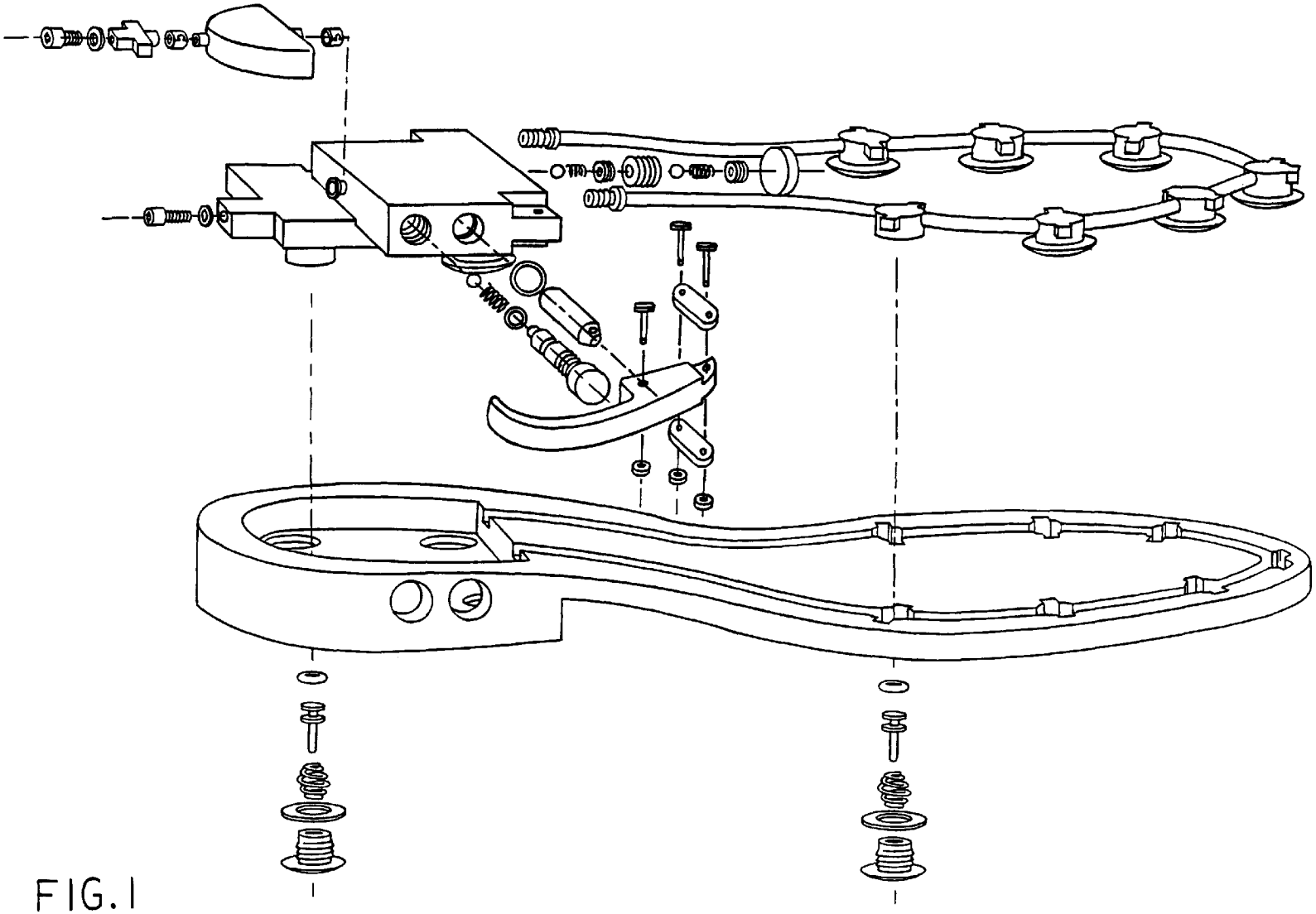

22 cylinder
24 return spring
26 slidable spike
30 gasket
32 housing conduit
32 A housing socket
32 B housing conduit
34 liquid press slidable spike assembly
36 manual pump body
40 check valve housing
41 check valve spring
42 plug
43 check valve retainer
44 control valve ball
45 control valve spring
46 control valve o ring
48 control valve
50 piston o ring
52 pump piston
54 pump body part
55 pin retainer
57 pins
58 lever linkage
59 lever
63 reservoir tube clamps
64 liquid input fitting
65 reservoir
66 port seal
68 port plug screw
70 auto diaphragm
72 fill port
74 bleed port
76 check valve
78 threaded rotatory spool valve
80 retaine
82 balloon reservoir
84 hard plate
86 shoe sole

DESCRIPTION—FIGS. 1 TO 12

Figure 2:
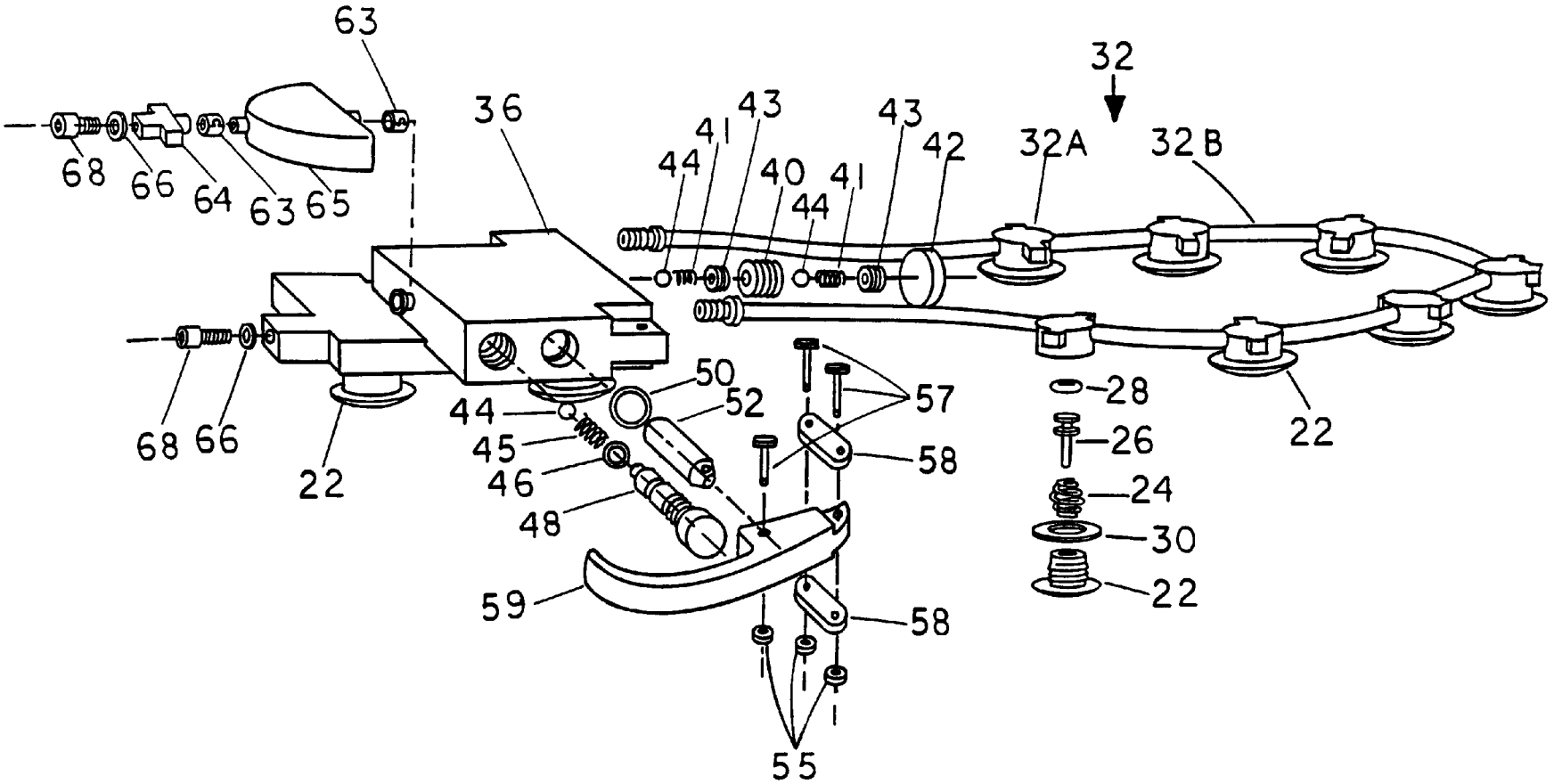

The manual pump body 36 of FIG. 2 is an independent body to be inserted into a shoe sole heel, or it's body may be a shoe heel, however tooling costs for the later are higher than the former because the former has a one size fits all ability.

Pump body 36 may be made in two pieces, the main body incorporating one socket housing with all the complex elements of the pump, a second unit comprising linked housing sockets may be snapped onto the main body, there by increasing or decreasing the spike pattern to accommodate larger or smaller shoe sole sizes. The advantage being that only the simpler made part need be changed for different size soles.

A typical embodiment of the present invention is illustrated in FIG. 2. The assembly consisting of a high pressure liquid pump body formed by injection molding from durable stretch resistant plastic such as nylon, or as mentioned, the heel of the shoe may also serve as the pump body 36. Said pump body receives pump piston 52 and O ring seal 50, into said body's cylinder cavity. Pump piston 52 is hinged to lever 59 by a pin 57 and held by a retainer 55. Lever 59 being free to pivot on the piston after being attached. The end of lever 59 is attached to linkage 58 by a pin 57 and held by a retainer 55. The free end of the linkage is then attached to pump body 36 by a pin 57 and held by retainer 55.

The control valve 48 and it's component O ring 46, spring 45, and ball 44, are inserted into pump body 36.

One or more spike cylinders 22, are threaded into the under side of pump body 36 FIG. 1.

Filler and bleeder port plug screws 68 and their seals 66 are removed and inserted as necessary.

The reservoir 65 is made from a material such as neoprene. The liquid input fitting 64 is independently contained within the shoe sole so that it will not turn. After the reservoir ports have been slid over the pump body port and fitting port 64, clamps 63 are permanently crimped closed.

Check valve assemblies are then inserted into the pump body cavity in a sequential order, first to last of, ball 44, spring 41, check ball retainer 43, and plug 42. Plug 42 may be either threaded in or heat welded.

Figure 4:
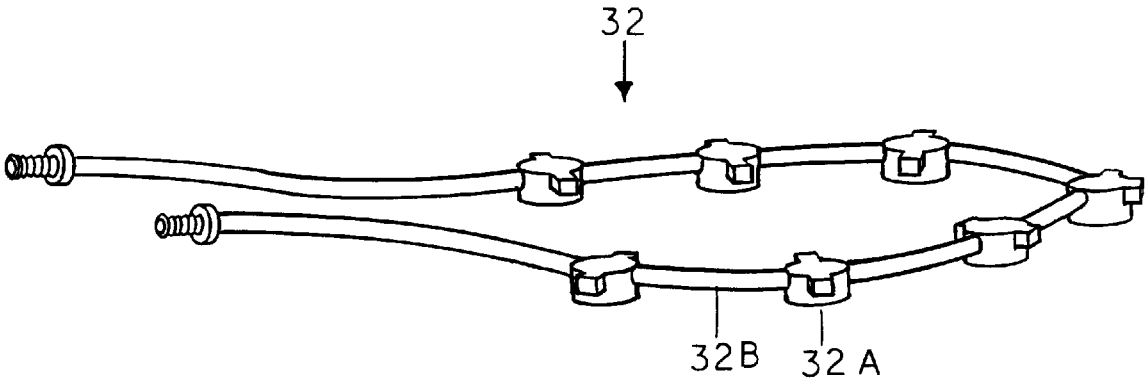

FIG. 4 shows the housing conduit 32 and it's respective shape break down of conduit 32B and housing socket 32A. The housing conduit 32 is made by plastic injection from non stretching but flexible material such as nylon. The ends of the conduit 32B incorporate locking rings for permanently locking into place after being pressed into respective pump body receiving holes. Housing conduit 32 has a bursting pressure in excess of 3000 p.s.i. and it's injection mold requires extensive sophisticated tooling. FIG. 2 shows the housing conduit 32A receiving the liquid pressure slidable spike assembly components in sequential order of first to last, O ring seal 28, spike 26, barrel spring 24, gasket 30, cylinder 22.

FIG. 1 shows a typical embodiment of the present invention aligned for insertion into preformed cavities in a shoe sole. An alternate method would be to fix assembly into a mold prior to injection or pressing.

Figure 7:
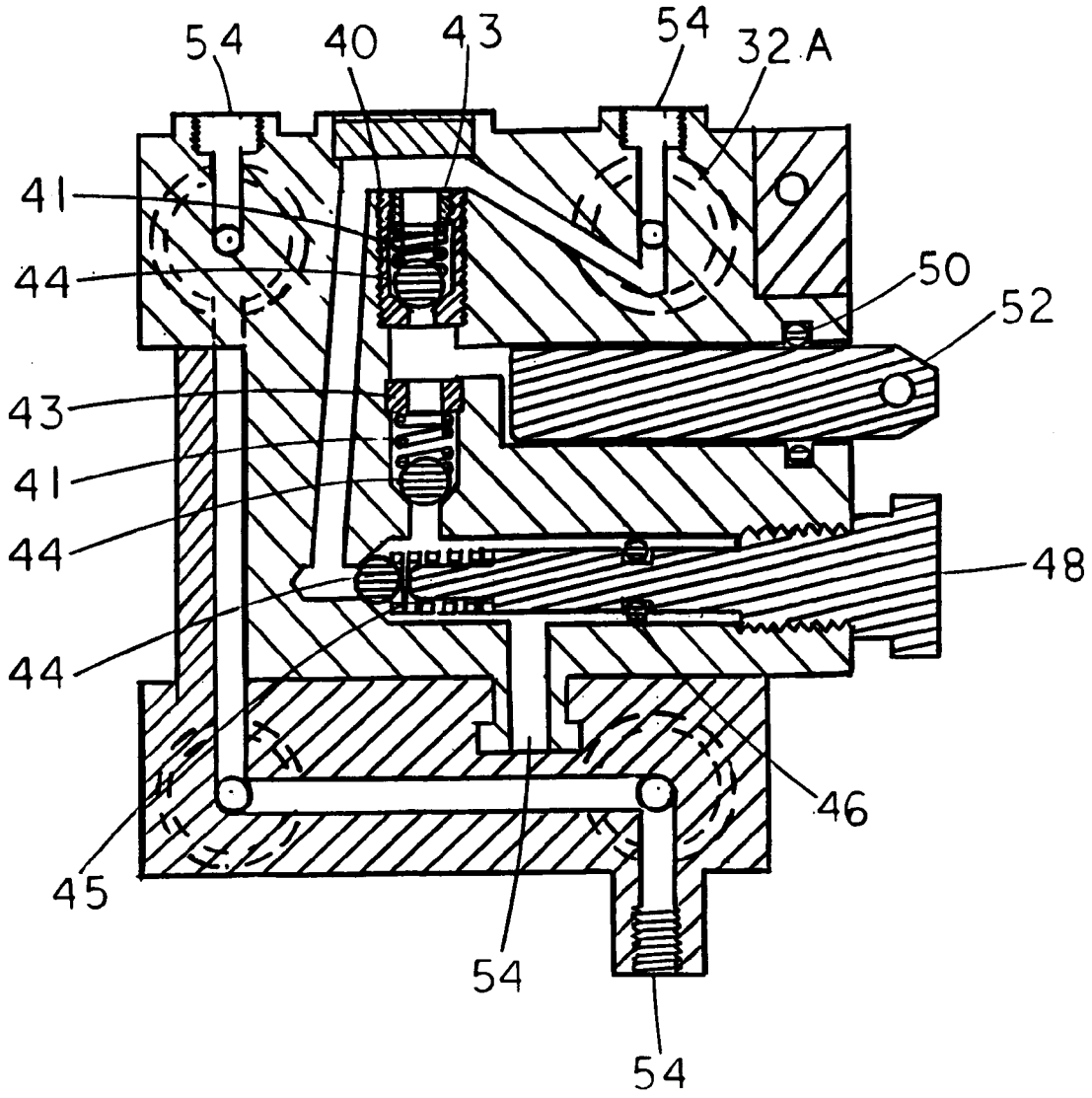
Figure 8:
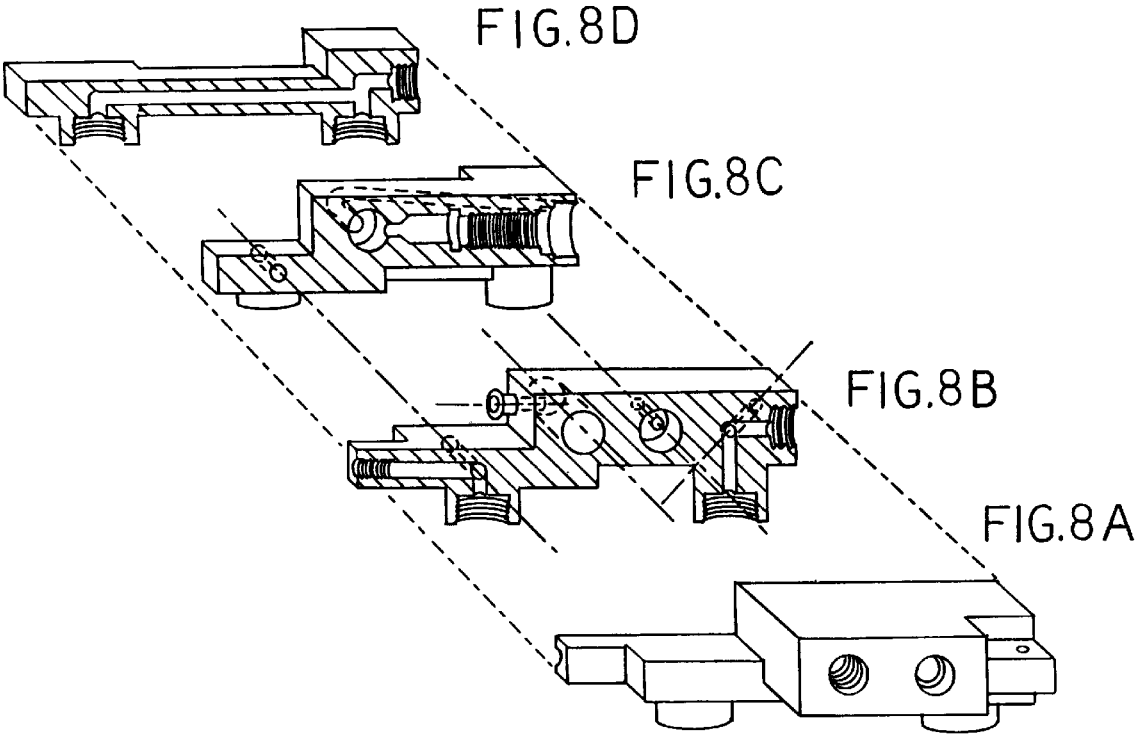
Figure 8:
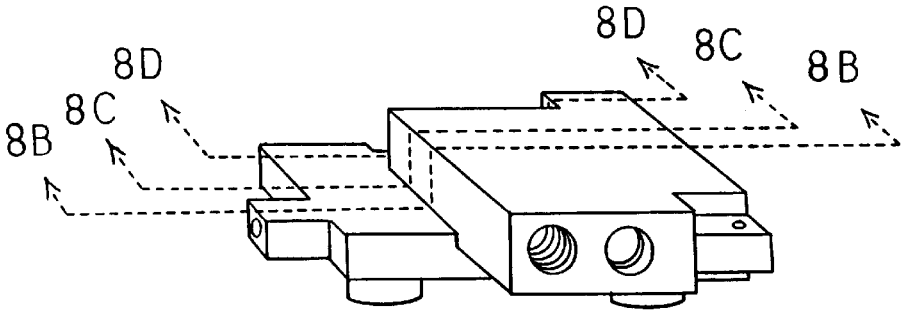

FIG. 7 shows a top section view of the manual pump after assembly. Ports 54 include fill port, bleed port, and self locking receiving ports for conduit ends 32B. All internal pump body cavities FIG. 8 are formed from sophisticated injection mold tooling.

Figure 9:
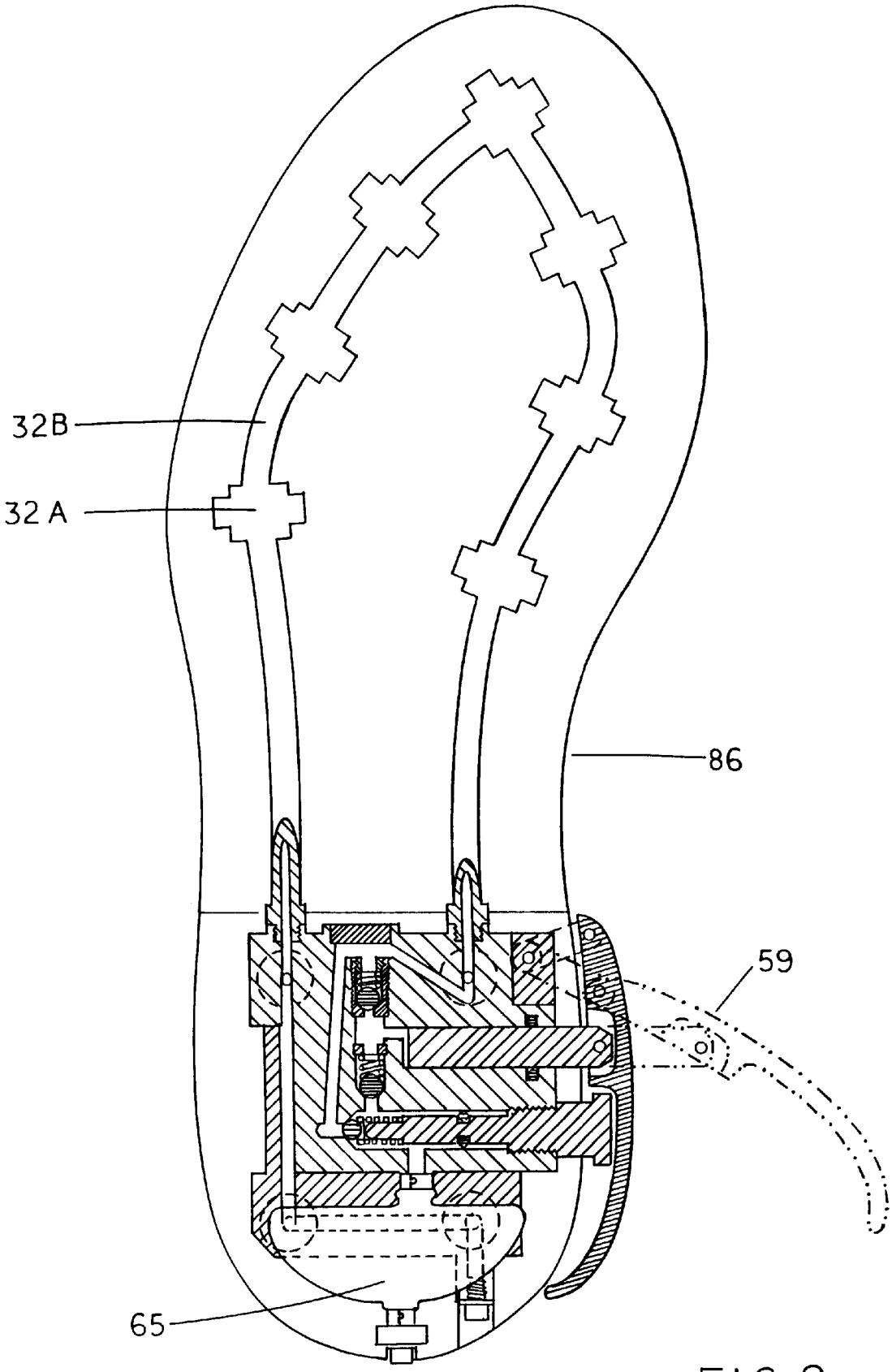

A detailed position of all components with in the shoe sole FIG. 9, the housing conduit 32 replicating conventional desirable spike positioning, and said conduit is flexible enough to change shape to accommodate change in shoe sole sizes. Lever 59 can be made from aluminum die casting or suitable plastic. The reservoir 65 may have a varying wall thickness, so that when operating under vacuum, collapsing portions are far away from the ports and do not interfere with port flow.

Figure 10:
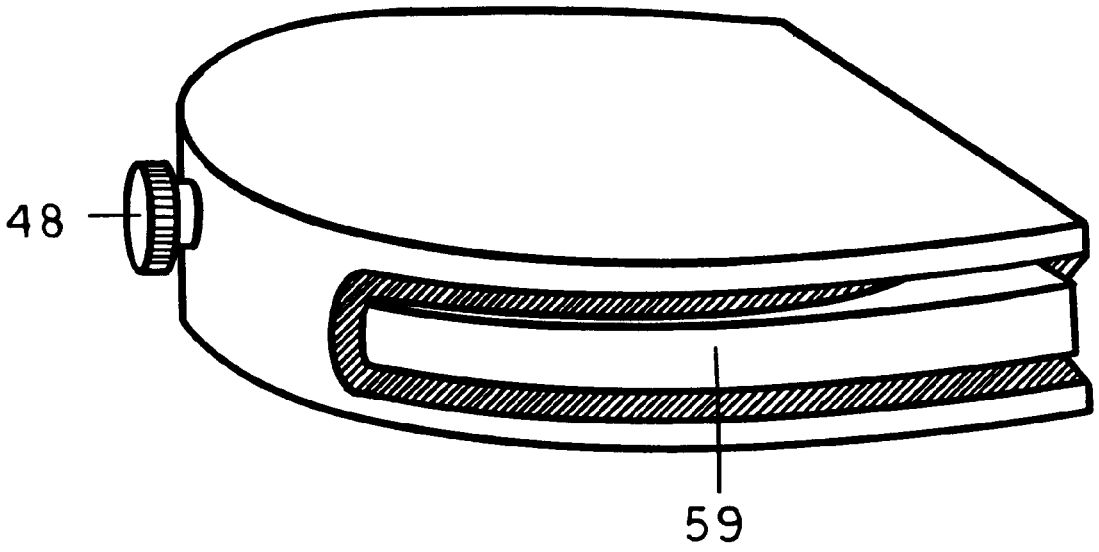

An alternative positioning of lever handle 59 is shown in FIG. 10. By altering the pump body design, the control valve 48 can be placed in areas other than beneath the lever 59. The lever 59 could then be flush with the shoe surface when not in use and not protrude.

Figure 11B:
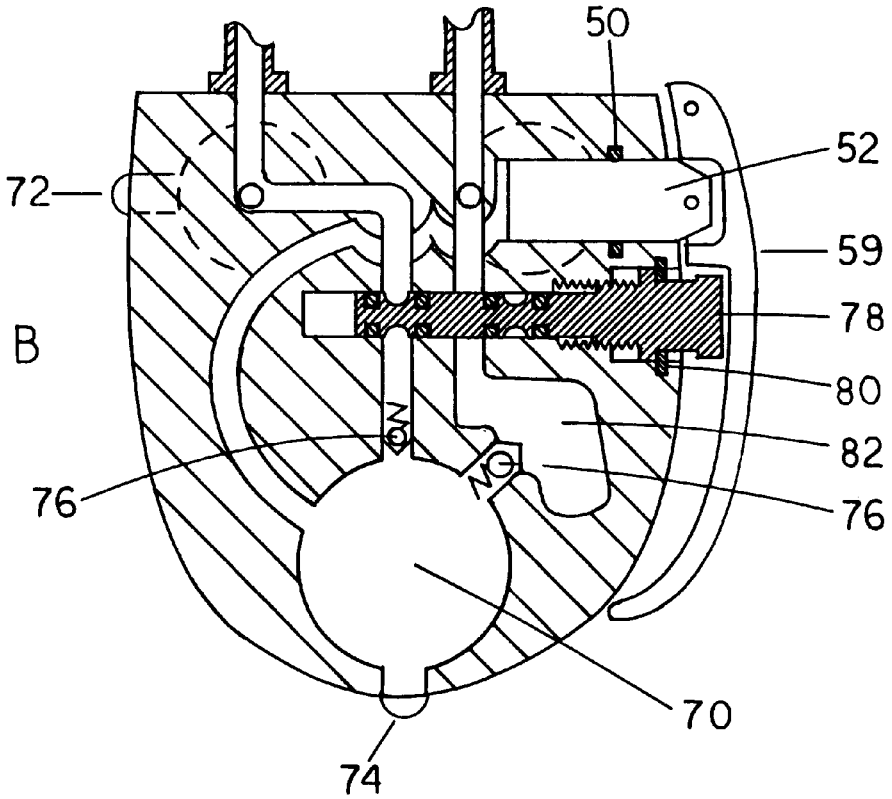
FIG. 11B shows a top view of the heel assembly with combined auto diaphragm and lever pump.
Figure 11A:
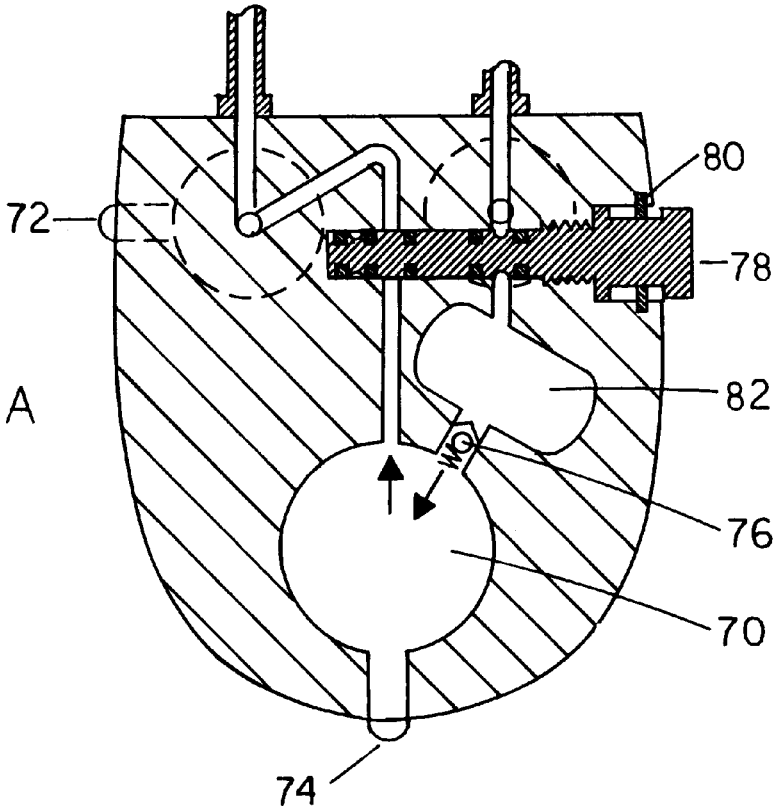
FIG. 11A shows a top view of the heel assembly with auto diaphragm pump.

A diaphragm pump assembly FIG. 11A, is placed into preformed cavities with in the sole 86. Diaphragm 70 is formed from a non stretching flexible durable material such as polyurethane and incorporates a bleeder valve port 74, a checked inlet port 76, and an outlet channel.

Figure 12:
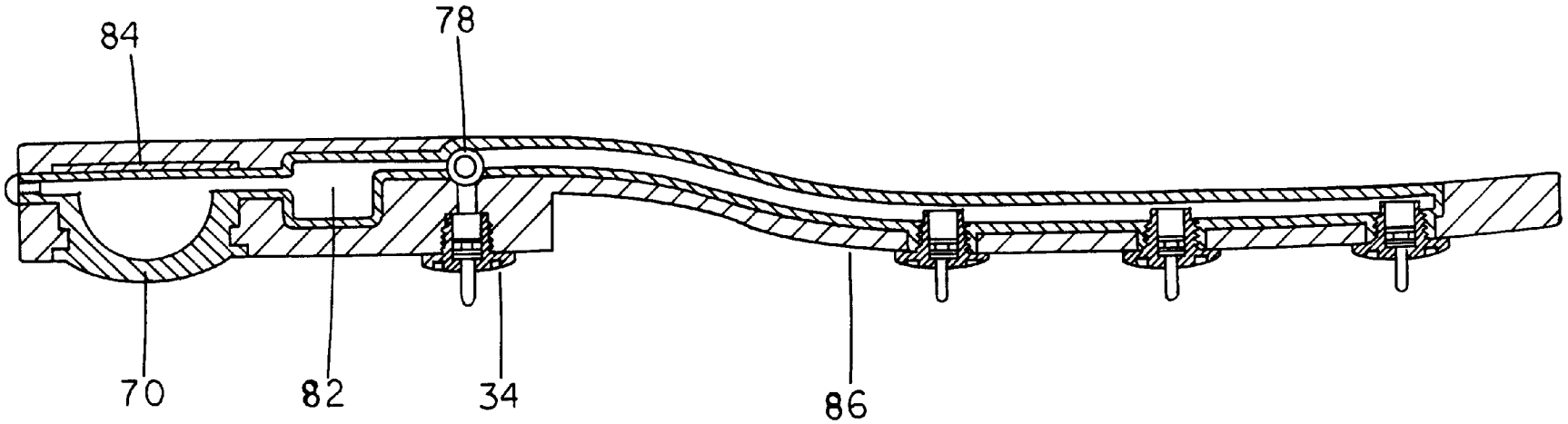
FIG. 12 shows a side section view of a full length shoe sole assembly with auto diaphragm pump.

The diaphragm FIG. 12 has a hard plate 84 above it and possibly around it. Diaphragm 70 is shaped with ringed grooves around it's sides and has a convex, domed out bottom. The diaphragm FIG. 12 has a tapering wall thickness with the thinnest wall area on the bottom.

The diaphragm pump reservoir 82, is a self collapsing reservoir like that of a balloon and is made from rubber type material, such as neoprene, by way of conventional plastic forming.

The threaded rotatory spool valve 78 is plastic or light weight metal, and comprises O rings and a snap ring retainer 80.

FIG. 11B, shows a combined auto diaphragm and levered piston in a single shoe.

All parts, with the exception of springs, reservoirs, and diaphragm, can be made from light weight plastic or light weight metal.

OPERATION—FIGS. 1–12

The lever 59 or diaphragm 70 are positioned to exert extreme force upon enclosed liquid. Lever 59 being hinged to pump body 36 by way of lever linkage 58 and pins 57 said pins held by retainers 55.

Lever 59 is attached pivotally to piston 52 by a pin 57 and pin retainer 55. The piston O ring 50 is placed with in a groove inside the 36 pump body cylinder. There for leverage upon sealed liquid beneath piston 52 creates extreme pressure with in an ejecting and retracting spiked shoe.

Liquid with in manual pump assembly FIG. 7 is moved by the reciprocating piston 52. When lever 59 pulls the piston 52 out, liquid from reservoir is drafted into the pump body cylinder., said drafted liquid has been pulled through check valve assembly 43, 41, and 44. Upon pushing lever 59 with the palm of the hand while finger tips are curled around the outer side of the heal, checked liquid is forced through the second check valve and out port.

The manual pump control valve assembly comprising a control valve 48, O ring seal 46, spring 45, and ball 44 is inserted and threaded into it's bore in pump body 36. When control valve 48 is screwed out, ball 44 backs away from it's seat allowing depressurization of the system and liquid to return to it's reservoir 65.

As mentioned, extreme liquid pressure is created by way of the auto diaphragm pump FIG. 11A, and FIG. 12. In actuality, the present invention being a pump which incorporates both a diaphragm and levered piston FIG. 11B, that is to say, auto pumping with manual override, is here produced initially at a lessor cost by making two separate shoe types, that of auto, and that of manual, for the consumer to choose from, thereby realizing a lower unit production cost resulting in a lower market cost.

The auto diaphragm assembly FIG. 11A and FIG. 12 is placed with in the heel of the shoe, said heel preferably acting as said assemblies encasement. In the forward walking of humans, the back area of the bottom of the heel is subject to the greatest load, of momentary pressure. This being the case it would serve as the most ideal area to place a diaphragm requiring high momentary pressure actuating force. The diaphragm 70 has a thick wall tapering down in thickness along the bottom to encourage reciprocation. A hard plate 84 is located on the top of said diaphragm to prevent bulging. Port 74 acts as the air bleed port and remains open upon filling the system with liquid. The spring loaded check valve 76, FIG. 11 is located between diaphragm 70 and reservoir 82. Check valve 76 allows liquid to constantly check into diaphragm 70 from reservoir 82. Diaphragm 70 is then constantly pressurized even when the spike line is depressurized, so that the feel of firmness is appreciated by the wearer. The reciprocation of diaphragm 70 only, occurs immediately after shifting to spike ejection mode, during the first few walking steps taken, after which the spike line contains maximum pressure.

The threaded rotatory spool valve, or T.R.S.V. 78, is threaded into its respective bore in the heel. Retainer ring 80 is snapped into its respective groove in said bore. A knob is part of the exterior end of said T.R.S.V. and used for manual turning. The turning of T.R.S.V. 78 is how shifting from one mode to another is accomplished. When T.R.S.V. is turned clockwise all the way in until its ring stops against a shoulder, the system is in a spike ejection mode. As previously mentioned, in this mode the diaphragm quickly builds to maximum pressure and then remains unreciprocating and solid. By turning the T.R.S.V. 78 counter clockwise, it moves out of it's bore via threads and stops by its shoulder ring against retainer ring 80, where in the T.R.S.V. 78 is now in spike retraction mode FIG. 11. In spike retraction mode, check valve 76 and T.R.S.V. 78 combine to close the spike line to pressure from diaphragm 70. In this way, the potential problem of fluctuating pressure in the spike line while a user is walking, is overcome. The said combined pump, comprising both auto and manual features, makes use of the T.R.S.V. 78.

The system is filled with liquid, via port 72, by either a squeeze bottle with threaded nozzle, or a line attached to a faucet, A water soluble lubricant may be added to fluid to provide lubrication.

Figure 3:
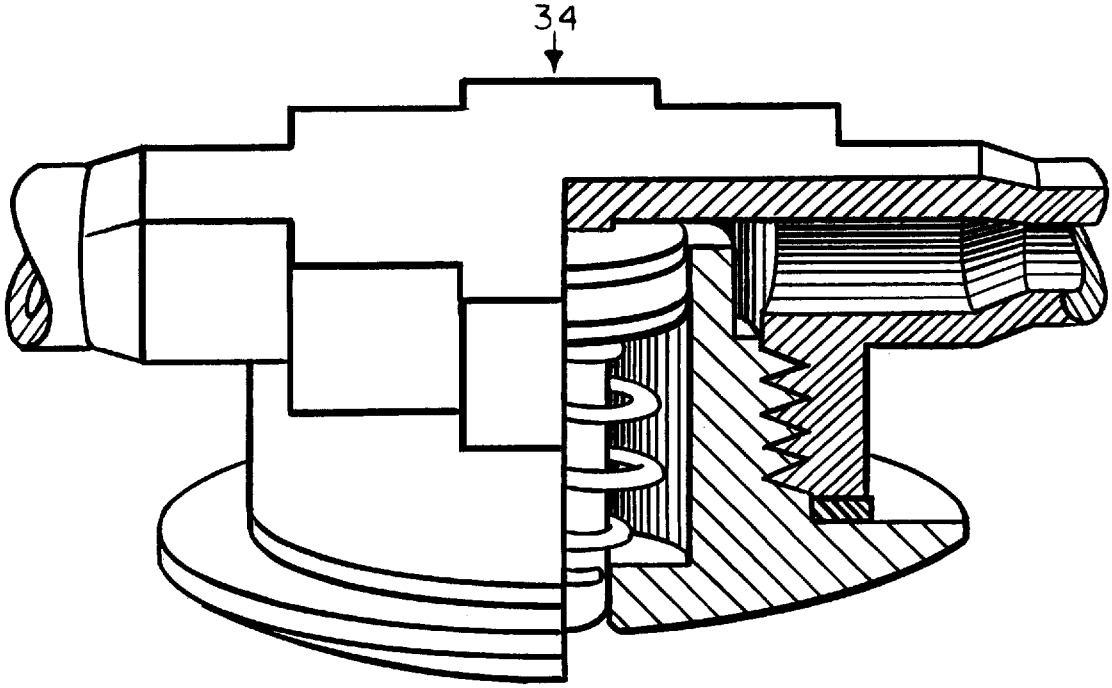
Figure 5:
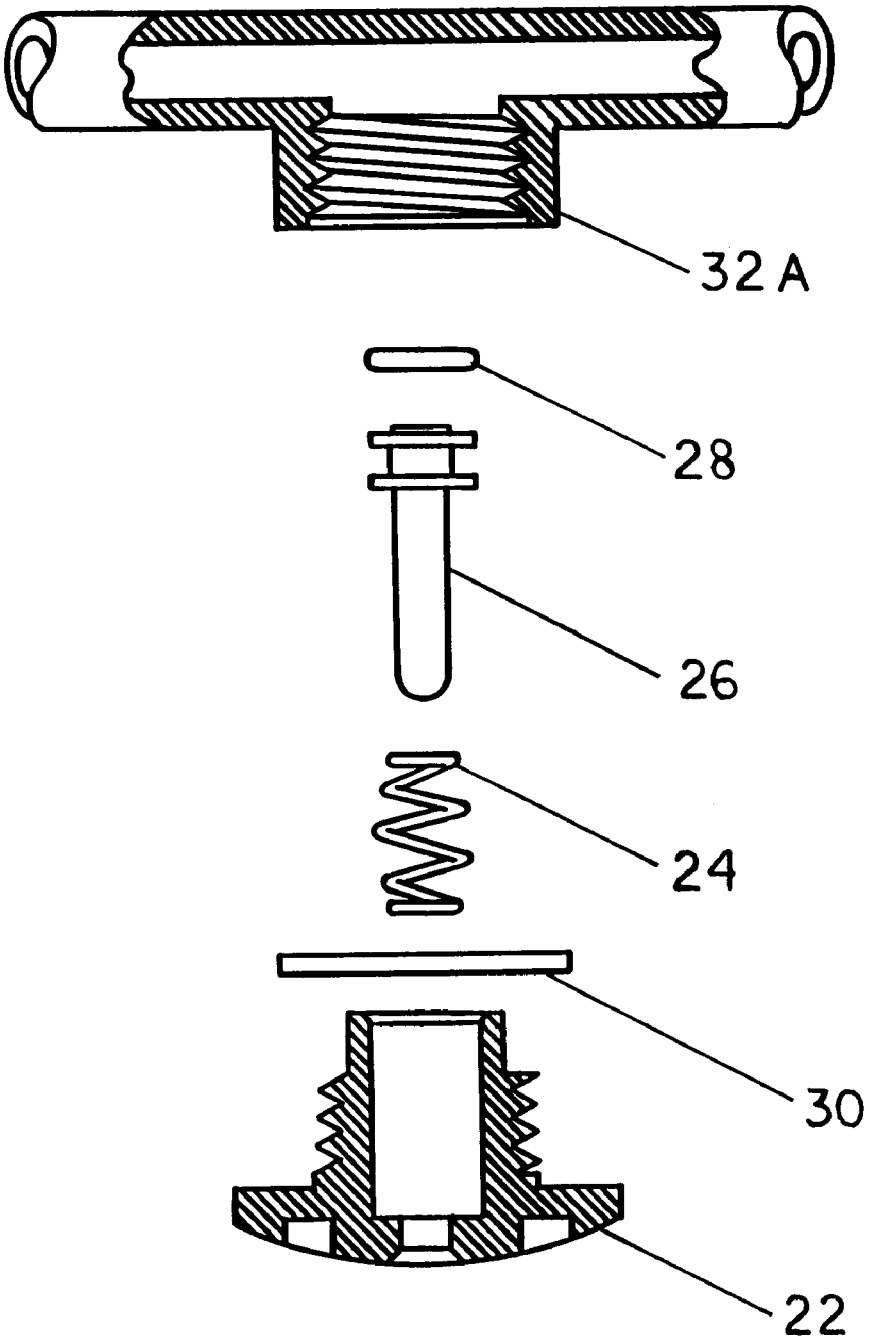

The liquid pressure slidable spike assembly or L.P.S.S.A. FIGS. 3, 5 and 6, has been designed to meet the specifications of fitting into a standard golf shoe sole thickness and still provide traditional 8 millimeter spike length.

There are six elements in the L.P.S.S.A. Element 32A is permanently fixed in the shoe sole and acts impart as a traditional threaded socket for receiving a spike. The outer top portion has a sharp geometric shape to resist turning. The inner ceiling has a slight protrusion that acts as a stop for upward motion of spike 26. This allows liquid pressure to re-enter over the top of said spike with pressure then positioned for downward urging upon said spike. There are two ports in every socket, said ports provide socket communication via conduit line.

Element 28 is an O ring seal which seats with in a groove in spike 26. Examples of other ramifications of seals are, a rubber cup type seal like that found in an automobile brake cylinder, a quad ring, a Teflon spike head, any form of high pressure seal attached to said spike, thereby moving with said spike.

Element 24 FIG. 5 is a return spring. Said spring has a barrel shape. It is designed so that it will coil within it's self when under compression, thus occupying only the vertical space of twice it's wire gauge FIG. 6B. It is specifically this shape and wire gauge that yields a combined superior expansion length and compressibility with in the scope of supplying ample force to urge the sealed piston upward into retracted position FIG. 6A.

Element 30 is a common gasket of any known gasket material, it is available from numerous supplies world wide, it's thickness is relevant.

Element 22 is a cylinder which has an outer domed convex bottom identical in size and shape to that of a conventional golf shoe, said outer bottom having two small blind bores enabling spike replacement in the field by use of a conventional tool. Said cylinder has a gasket seat shoulder incorporated into it's shape.

Said cylinder has a small bore in the bottom to allow said spike to eject out for use. The said bore must also act as a bushing and it's dimension is relevent. If the clearance between said bore and spike is to great, more than 0.003", the alignment of seal 28 may be affected and a lateral motion of said ejected spike may result. To small a bore with little or no clearance between the spike and bore results in air being trapped in the cylinder bore beneath the spike seal, said trapped air becoming extremely compressed and counter productive to ejection urging.

Said cylinder has the absence of threads on its upper portion, said upper portion has a smaller diameter than the root diameter of existing threads on it's lower portion. When the unit is assembled FIGS. 6 and 3, an interior space exists to accommodate liquid flow from ports positioned lower than the cylinder top. Liquid flow then travels over the top of the inner cylinder walls and into said inner cylinder. It is this unique combination that gives the L.P.S.S.A. maximum slidable spike distance within a minimum overall assembly height. Thusly it is achieved that conventional 8 millimeter spike length is ejected and retracted within the traditional golf shoe sole thickness.

The space that exists to accommodate liquid flow discussed above can be created by alternate means of removing threads from the socket instead of the cylinder, or both socket and cylinder, or by providing a cavity in the cylinder wall, or by any means, it is the said space combined with an open ended inner cylinder that allows such low port and high cylinder operation FIG. 3.

SUMMARY, RAMIFICATIONS, AND SCOPE

Accordingly the reader will see that the golf shoe with high pressure inducing spike ejection of this invention provides a highly durable, reliable, and light weight shoe that maintains the desirable appearance and characteristics of current fixed spike market trends.

The lever action or auto diaphragm liquid pump assembly offering extreme pressure with minimal effort is greatly advantageous when combined with the liquid pressure slidable spike assembly. It is clear to see that the L.P.S.S.A. is most advantageous in it's power of ejection, it's minimal height, it's eight millimeter slidable ability, it's ease of replacing worn spikes, it's compact lightness of weight, it's friction free movement of parts, and it's unbreakable durability. It is also apparent that the golf shoe with high liquid pressure, in excess of 1,000 p.s.i., inducing spike ejection, provides the equivalent spike firmness of the popular conventional fixed spike golf shoes, but with spike retraction, offers itself as the total panacea in the preservation of golf and golf course greens Although the description above contains many specificity's, these should not be construed as limiting the scope of the invention but as merely providing illustrations of some of the presently preferred embodiments of this invention. For example, retraction means other than spring may be used. Fluid pressure supplied by additional pressure lines that enter beneath the ejected spike seal, and controlled by a four way valve would be possible. The alternate positioning of valves knobs and handles. The use of the invention in activities other than golf. The lengthening of the spikes in order that a stub spike is still present in full retracted position, thereby having a combined non ground penetrating short spike in retracted position, and a traditional 8 millimeter spike in ejected position. Both lever pump and diaphragm pump can be easily combined into one pump FIG. 11B. The addition or subtraction of pump assembly parts, resulting in an operable unit with more or less function and efficiency.

Thus the scope of the invention should be determined by the appended claims and their legal equivalents, rather than by the examples given.

We claim:

1. A shoe, comprising:

a sole;

a reservoir arranged in said sole and containing a supply of an incompressible liquid; a plurality of slidable spike assemblies arranged in said sole and connected to said reservoir, said slidable spike assemblies including retractable spikes;

a hydraulic pump arranged in said sole and connected to said reservoir and said slidable spike assemblies, said hydraulic pump pumping said incompressible liquid from said reservoir to said slidable spike assemblies under enough pressure to eject said spikes and to firmly maintain said spikes in a fully ejected position even when walking; and a first check valve connected between said reservoir and said hydraulic pump to restrict liquid flow in a single direction from said reservoir to said hydraulic pump, a second check valve connected between said hydraulic pump and said slidable spike assemblies to restrict liquid flow in single direction from said hydraulic pump to said slidable spike assemblies to eject said spikes, and a control valve connected between said slidable spike assemblies and said reservoir to enable said incompressible liquid to return to said reservoir to depressurize said slidable spike assemblies and retract said spikes.

2. A shoe, comprising:

a sole;

a reservoir arranged in said sole and containing a supply of an incompressible liquid;

a plurality of slidable spike assemblies arranged in said sole and connected to said reservoir, said slidable spike assemblies including retractable spikes;

a hydraulic pump arranged in said sole and connected to said reservoir and said slidable spike assemblies, said hydraulic pump pumping said incompressible liquid from said reservoir to said slidable spike assemblies under enough pressure to eject said spikes and to firmly maintain said spikes in a fully ejected position even when walking; and a control valve connected between said slidable spike assemblies and said hydraulic pump, said control valve directing said incompressible liquid from said reservoir to said hydraulic pump when closed, and directing said incompressible liquid from said slidable spike assemblies to said reservoir when opened.

3. A shoe, comprising:

a sole;

a reservoir arranged in said sole and containing a supply of an incompressible liquid;

a plurality of slidable spike assemblies arranged in said sole and connected to said reservoir, said slidable spike assemblies including retractable spikes;

a hydraulic pump arranged in said sole and connected to said reservoir and said slidable spike assemblies, said hydraulic pump pumping said incompressible liquid from said reservoir to said slidable spike assemblies under enough pressure to eject said spikes and to firmly maintain said spikes in a fully ejected position even when walking; and a control valve connected between said reservoir and said hydraulic pump, said control valve having an inner end which is smaller in diameter than a bore in said sole receiving said inner end to provide a liquid passage between said reservoir and said hydraulic pump.

4. A shoe, comprising:

a sole;

a reservoir arranged in said sole and containing a supply of an incompressible liquid;

a plurality of slidable spike assemblies arranged in said sole and connected to said reservoir, said slidable spike assemblies including retractable spikes;

a hydraulic pump arranged in said sole and connected to said reservoir and said slidable spike assemblies, said hydraulic pump pumping said incompressible liquid from said reservoir to said slidable spike assemblies under enough pressure to eject said spikes and to firmly maintain said spikes in a fully ejected position even when walking; and a cylindrical rotatory spool valve with a first narrowed section and a second narrowed section alternately positionable between a first liquid passage and a second liquid passage, respectively, said spool valve being movable between a first position and a second position by rotating a knob on one end thereof, said first narrowed section being positioned in said first liquid passage when said second narrowed section is positioned out of said second liquid passage, and vice versa, said spool valve enabling liquid flow from said hydraulic pump to said slidable spike assemblies to enable spike ejection in said first position, and enabling liquid flow from said slidable spike assemblies to said reservoir to enable spike retraction in said second position.

5. A shoe, comprising:

a sole;

a reservoir arranged in said sole and containing a supply of an incompressible liquid;

a plurality of slidable spike assemblies arranged in said sole and connected to said reservoir, said slidable spike assemblies including retractable spikes; and a hydraulic pump arranged in said sole and connected to said reservoir and said slidable spike assemblies, said hydraulic pump pumping said incompressible liquid from said reservoir to said slidable spike assemblies under enough pressure to eject said spikes and to firmly maintain said spikes in a filly ejected position even when walking;

wherein said hydraulic pump is comprised of a manual piston pump, and further including an automatic diaphragm pump connected to said slidable spike assemblies to also enable automatic pumping when walking.

6. A shoe, comprising:

a sole;

a reservoir arranged in said sole and containing a supply of an incompressible liquid;

a plurality of slidable spike assemblies arranged in said sole and connected to said reservoir, said slidable spike assemblies including retractable spikes; and a hydraulic pump arranged in said sole and connected to said reservoir and said slidable spike assemblies, said hydraulic pump pumping said incompressible liquid from said reservoir to said slidable spike assemblies under enough pressure to eject said spikes and to firmly maintain said spikes in a fully ejected position even when walking, said hydraulic pump comprising:

a piston; and a hinged lever connected to said piston, said lever enabling said hydraulic pump to produce enough pressure to maintain said slidable spike assemblies in said fully ejected position even when walking.

7. The shoe of claim 6, wherein said lever is hinged to a curved side edge of said sole, and is curved to follow said curved side edge of said sole.

8. The shoe of claim 6, wherein said lever is positioned flush within a recessed area along a side edge of said sole when inactive.

9. The shoe of claim 6, wherein said lever is hinged to a curved side edge of said sole, and is curved to follow said curved side edge of said sole, said lever is positioned flush within a recessed area along said side edge of said sole when inactive.

10. The shoe of claim 6, further including a first check valve connected between said reservoir and said hydraulic pump to restrict liquid flow in a single direction from said reservoir to said hydraulic pump, a second check valve connected between said hydraulic pump and said slidable spike assemblies to restrict liquid flow in single direction from said hydraulic pump to said slidable spike assemblies to eject said spikes, and a control valve connected between said slidable spike assemblies and said reservoir to enable said incompressible liquid to return to said reservoir to depressurize said slidable spike assemblies and retract said spikes.

11. The shoe of claim 6, further including a control valve connected between said slidable spike assemblies and said hydraulic pump, said control valve directing said incompressible liquid from said reservoir to said hydraulic pump when closed, and directing said incompressible liquid from said slidable spike assemblies to said reservoir when opened.

12. The shoe of claim 6, further including a control valve connected between said reservoir and said hydraulic pump, said control valve having an inner end which is smaller in diameter than a bore in said sole receiving said inner end to provide a liquid passage between said reservoir and said hydraulic pump.

13. The shoe of claim 6, further including a cylindrical rotatory spool valve with a first narrowed section and a second narrowed section alternately positionable between a first liquid passage and a second liquid passage, respectively, said spool valve being movable between a first position and a second position by rotating a knob on one end thereof, said first narrowed section being positioned in said first liquid passage when said second narrowed section is positioned out of said second liquid passage, and vice versa, said spool valve enabling liquid flow from said hydraulic pump to said slidable spike assemblies to enable spike ejection in said first position, and enabling liquid flow from said slidable spike assemblies to said reservoir to enable spike retraction in said second position.

14. The shoe of claim 6, further including an automatic diaphragm pump connected to said slidable spike assemblies to also enable automatic pumping when walking.

15. A shoe, comprising:

a sole;

a reservoir arranged in said sole and containing a supply of an incompressible liquid;

a plurality of slidable spike assemblies arranged in said sole and connected to said reservoir, said slidable spike assemblies each comprising:

an internally threaded housing socket with a closed top and an open bottom;

a housing conduit connected to a top end of a side wall of said housing socket;

an externally threaded cylinder screwed into said housing socket, an open top of said cylinder being spaced from said top of said housing socket by less than a diameter of said housing conduit for minimizing a combined height of said housing socket and said cylinder;

a slidable spike positioned in said cylinder and movable between an ejected position projecting from a bottom of said cylinder, and a retracted position inside said cylinder; and an O-ring seal positioned around a top end of said spike; and a hydraulic pump arranged in said sole and connected to said reservoir and said slidable spike assemblies, said hydraulic pump pumping said incompressible liquid from said reservoir to said slidable spike assemblies under enough pressure to eject said spikes and to firmly maintain said spikes in a fully ejected position even when walking.

16. The shoe of claim 15, wherein said hydraulic pump is comprised of a diaphragm pump positioned in a heel of said sole for being automatically actuated by walking.

17. The shoe of claim 15, wherein said hydraulic pump is comprised of a piston and a hinged lever connected to said piston, said lever enabling said hydraulic pump to produce enough pressure to maintain said slidable spike assemblies in said fully ejected position even when walking.

18. The shoe of claim 15, further including a first check valve connected between said reservoir and said hydraulic pump to restrict liquid flow in a single direction from said reservoir to said hydraulic pump, a second check valve connected between said hydraulic pump and said slidable spike assemblies to restrict liquid flow in single direction from said hydraulic pump to said slidable spike assemblies to eject said spikes, and a control valve connected between said slidable spike assemblies and said reservoir to enable said incompressible liquid to return to said reservoir to depressurize said slidable spike assemblies and retract said spikes.

19. The shoe of claim 15, further including a cylindrical rotatory spool valve with a first narrowed section and a second narrowed section alternately positionable between a first liquid passage and a second liquid passage, respectively, said spool valve being movable between a first position and a second position by rotating a knob on one end thereof, said first narrowed section being positioned in said first liquid passage when said second narrowed section is positioned out of said second liquid passage, and vice versa, said spool valve enabling liquid flow from said hydraulic pump to said slidable spike assemblies to enable spike ejection in said first position, and enabling liquid flow from said slidable spike assemblies to said reservoir to enable spike retraction in said second position.

20. The shoe of claim 15, further including a control valve connected between said slidable spike assemblies and said hydraulic pump, said control valve directing said incompressible liquid from said reservoir to said hydraulic pump when closed, and directing said incompressible liquid from said slidable spike assemblies to said reservoir when opened.

* * * * *